US007318737B2

(12) United States Patent
Yokoyama

(10) Patent No.: US 7,318,737 B2
(45) **Date of Patent: *Jan. 15, 2008**

(54) CONNECTOR

(75) Inventor: Hiromasa Yokoyama, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/572,284

(22) PCT Filed: Sep. 22, 2004

(86) PCT No.: PCT/JP2004/013845

§ 371 (c)(1),
(2), (4) Date: Mar. 16, 2006

(87) PCT Pub. No.: WO2005/031924

PCT Pub. Date: Apr. 7, 2005

(65) Prior Publication Data

US 2007/0117451 A1 May 24, 2007

(30) Foreign Application Priority Data

Sep. 26, 2003 (JP) ..... 2003-336572

(51) Int. Cl.
*H01R 13/15* (2006.01)

(52) U.S. Cl. ..... 439/260

(58) Field of Classification Search ..... 439/260, 439/495, 267

See application file for complete search history.

(56) References Cited

U.S. PATENT DOCUMENTS 5,476,393 A * 12/1995 Narita ..... 439/495
6,755,682 B2 * 6/2004 Kunishi et al. ..... 439/495
6,997,729 B2 * 2/2006 Sunaga ..... 439/260
7,044,773 B2 * 5/2006 Suzuki et al. ..... 439/495

(Continued)

FOREIGN PATENT DOCUMENTS

JP 07-018386 U 3/1995

(Continued)

OTHER PUBLICATIONS

International Search Report.

*Primary Examiner*—Phuong Dinh
(74) *Attorney, Agent, or Firm*—Rader, Fishman & Grauer, PLLC

(57) ABSTRACT

A connector having a substantially box-like housing having an insertion opening into which an FPC is inserted, a two-forked contact placed inside the housing, and a lever provided so as to face the insertion opening of the housing and pivotably held by the housing. The two-forked contact has a base section held by the housing, an upper arm and a lower arm that extend from the base section toward the insertion opening, and two-forked engagement arms extending from the base section in the opposite direction to the insertion opening. The lever has a grip section, a rotating shaft provided on the grip section and held by the housing, and a first plate cam provided on the rotating shaft and engaging the engaging arm. When the grip section is opened, the first plate cam widens the interval between the two-forked engagement arms, widening the interval between the upper arm and the lower arm of the two-forked contact.

11 Claims, 5 Drawing Sheets

U.S. PATENT DOCUMENTS

| | | | | |
|---|---|---|---|---|
| 7,083,455 | B1 * | 8/2006 | Miura et al. | 439/260 |
| 7,112,079 | B2 * | 9/2006 | Miura et al. | 439/260 |
| 2006/0110965 | A1 * | 5/2006 | Koga | 439/260 |
| 2006/0270270 | A1 * | 11/2006 | Yokoyama | 439/495 |
| 2007/0032115 | A1 * | 2/2007 | Takashita | 439/260 |

FOREIGN PATENT DOCUMENTS

| | | | |
|---|---|---|---|
| JP | 3019279 | U | 12/1995 |
| JP | 10-208810 | A | 8/1998 |
| JP | 11-031561 | A | 2/1999 |
| JP | 11-224745 | A | 8/1999 |
| JP | 11-307198 | A | 11/1999 |
| JP | 2000-123897 | A | 4/2000 |
| JP | 2000-315536 | A | 11/2000 |
| JP | 2001-006778 | A | 1/2001 |
| JP | 2001-076794 | A | 3/2001 |
| JP | 2001-345136 | A | 12/2001 |
| JP | 2002-270290 | A | 9/2002 |
| JP | 2004-221067 | A | 8/2004 |
| JP | 2004-342426 | A | 12/2004 |

* cited by examiner

CONNECTOR

TECHNICAL FIELD

The present invention relates to a connector for connecting a flat flexible cable such as an FPC (Flexible Printed Circuit), FFC (Flexible Flat Cable), and so forth. In particular, the present invention relates to a connector which enables the user to insert a flat flexible cable such as an FPC, FFC, and so forth, with almost zero insertion force.

BACKGROUND ART

An FPC includes a great number of terminals in parallel. The FPC having such a structure is detachably connected to a printed board using a connector including a great number of contacts provided in parallel. Conventional connectors are known as disclosed in Patent Documents 1, 2, and so forth, in which the contact members and the terminals of the FPC are pressed in contact with each other through an operating member so as to connect the great number of terminals with the contact members all at the same time. With such a conventional structure, the FPC is held in a sure manner without undesirable disengagement thereof from the connector.

A connector disclosed in Patent Document 1 includes a housing having a structure in which an FPC insertion opening is formed on one face thereof for the insertion of an FPC, and a cover insertion opening is formed on the other face thereof for the insertion of a cover. On the other hand, each contact member includes a pressing portion provided so as to face the cover insertion opening, and a contact portion provided so as to face the FPC insertion opening. With such an arrangement, upon inserting the cover into the cover insertion opening, each pressing portion is elastically bent. This action, in which each pressing member is elastically bent, presses the corresponding contact portion into contact with the FPC.

With such an arrangement, upon inserting the cover into the cover insertion opening formed on one face of the housing after the insertion of the FPC into the FPC insertion opening formed on the other face of the housing, the pressing portion of each contact member is elastically bent. This action presses the contact portion of the contact member into contact with the FPC. Thus, the FPC is pressed into contact with, and is connected with, the contact members.

On the other hand, a connector disclosed in Patent Document 2 includes: an insulating housing and a cover provided so as to allow the user to turn the cover in the longitudinal direction of the insulating housing. The insulating housing has a structure in which an insertion opening is provided at the front end thereof for the insertion of a flat flexible cable. Furthermore, multiple electroconductive terminals (contact members) are provided in parallel within the housing such that contact beams thereof face the insertion opening. Each of the electroconductive terminals (contact members) has a base beam and a U-shaped contact beam connected with one another through a connection portion so as to form a single unit. An engaging arm is provided at the rear end of each base beam. On the other hand, a lever arm is provided at the rear end of each contact beam. An engaging portion formed of the engaging arms of the multiple electroconductive terminals (contact members) provided in parallel and another engaging portion of the cover are engaged with one another in a manner which allows the user to turn the cover. Furthermore, the lever arm and the cover are provided such that the lever arm and the inner face of the cover face one another at the rear end of the cover. Such a structure allows the user to open and close the portion facing the U-shaped contact beam by turning the cover using the lever arm.

With such a structure, upon turning the cover, the inner face of the cover moves the lever arm. Then, the movement of the lever opens and closes the contact beams of the electroconductive terminals (contact members). After the opening of the contact beams, the user can insert the connection terminal of a flat flexible cable into the insertion opening with zero insertion force. Upon closing the contact beams, the contact beams are pressed into contact with the flat flexible cable with a certain contact pressure due to the elasticity of the contact beams. With such an arrangement, the opening and closing of the contact beams is performed by actions of the lever arms. This enables the user to turn the cover without large insertion force.

Patent Document 1: Japanese Unexamined Utility Model Registration Application Publication No. 7-18386

Patent Document 2: Japanese Utility Model Registration No. 3019279

Problems to be Solved by the Invention

However, the connector disclosed in Patent Document 1 has a problem as follows. With the connector disclosed in Patent Document 1, upon inserting a flat flexible cable into the connector, the pressing portion of each contact member is elastically bent. This action presses the contact portion of each contact member into contact with the FPC. This means that stress is applied to each contact member during connection of the FPC with the connector. This causes creep, for example, leading to deterioration in the durability of the connector.

On the other hand, the connector disclosed in Patent Document 2 has a problem as follows. With the connector disclosed in Patent Document 2, the cover is turned while engaging the engaging portion, which are formed of lever arms disposed in parallel on the rear side of the electroconductive terminals (contact members), with the engaging portion of the cover. With such a structure, stress is applied to the lever arms disposed at the rear side of the electroconductive terminals (contact members) every time the user opens or closes the cover. This causes deterioration in the durability of the connector. On the other hand, the cover is not engaged with the housing. In some cases, this leads to undesirable disengagement of the FPC from the connector.

The present invention has been made in view of the aforementioned problems. Accordingly, it is an object thereof to provide a connector which enables the lever serving as a cover to be maintained in an open or closed state in a certain manner while improving the durability thereof.

DISCLOSURE OF THE INVENTION

Means for Solving the Problems

In order to solve the aforementioned problems, the inventor has provided a new connector as follows.

In the first aspect of the present invention, a connector includes: an approximately box-shaped housing having an insertion opening for the insertion of an FPC; forked contact members provided within the housing; and a lever which is provided so as to face the insertion opening of the housing, and which is turnably held by the housing. With such an arrangement, the forked contact member includes a base held by the housing, an upper arm and a lower arm extending toward the insertion opening from the base, and a forked engaging arm provided so as to extend from the base in the opposite direction of the insertion opening. The lever includes a handle portion, a rotational shaft which is provided to the handle portion, and which is held by the housing, and first plate cams which are provided to the rotational shaft, and which are engaged with the engaging arm. Upon raising the lever through the handle portion, the distance between the tips of the forked engaging arms is increased through the first plate cam, thereby increasing the distance between the upper arm and the lower arm of each of the forked contact members.

Upon raising the handle portion, the distance between the engaging arms of each forked contact member is increased by actions of the first plate cam. This action increases the distance between the upper arm and the lower arm of each forked contact member. Then, upon pressing down the handle portion after the insertion of an FPC, the distance between the engaging arms of each forked contact member is returned to the initial distance by actions of the first plate cam. At the same time, the upper arm and the lower arm of each forked contact member are returned to the initial state due to the elasticity thereof. In this state, the FPC is held by the elastic force of the forked contact members, thereby maintaining the connection state of the FPC. With such an arrangement, upon raising the handle portion, the distance between the upper arm and the lower arm of each forked contact member is increased to a distance greater than the thickness of an FPC to be inserted into the space between the upper arms and the lower arms of the forked contact members. This enables the user to insert and remove the FPC with a slight application of force.

As described above, the connector according to the present invention has a structure which allows the user to increase the distance between the upper arm and the lower arm of each forked contact member by turning and raising the handle portion. In the state in which the distance between the upper arm and the lower arm of each forked contact member is set to be larger, insertion of the FPC requires almost zero force. Upon turning and pressing down the handle portion after the insertion of the FPC, the upper arm and the lower arm of each forked contact are returned to the initial state by the elasticity of each forked contact member. This enables the FPC to be held while maintaining the connection state thereof. With such an arrangement, external stress is not applied to each forked contact member while the FPC is in a connected state. This improves the durability of the forked contact members.

In the second aspect of the present inventions, in a connector described in the first aspect of the invention, the housing includes a pair of connection tabs for connection to a printed board, embedded in both side ends thereof with the insertion opening introduced therebetween.

With such an arrangement according to the present invention, the housing is connected to the printed board through the connection tabs embedded in both side ends of the housing. Furthermore, the rotational shaft of the lever is turnably held by the connection tabs. As described above, the connection tabs press fitted to the housing have two functions. One is the function of fixing the connector to the printed board. The other is the function of turnably holding both ends of the rotational shaft. Such an arrangement including the connection tabs having these two functions allows the connector to have a compact structure.

In the third aspect of the present invention, in a connector described in the first aspect of the invention, the rotational shaft is formed of rigid metal. Furthermore, the handle portion is formed of an insulating material. The rotational shaft and the handle shaft form a single unit.

With such an arrangement according to the present invention, the rotational shaft is formed of rigid metal, thereby suppressing deflection of the rotational shaft at the time of raising or lowering the handle portion. Note that an arrangement may be made in which the exposed metal face of the rotational shaft is coated with an insulating film after formation of the rotational shaft and the handle portion as a single unit.

In the fourth aspect of the present invention, in a connector described in any one of the first to third aspects of the invention, the lever includes second plate cams which are provided to the rotational shaft, and which are engaged with the housing.

With such an arrangement according to the present invention, the second plate cams are provided such that they are in contact with the housing. This stably maintains the state in which the lever is closed. An arrangement employing such a connector has the advantage of preventing undesirable rising of the lever, thereby maintaining the connection state of the FPC.

In the fifth aspect of the present invention, in a connector described in the fourth aspect of the invention, the first plate cams and the second plate cams are alternately disposed along the axial direction of the rotational shaft.

With such an arrangement according to the present invention, the second plate cams alternately disposed along the axis of the rotational shaft are provided such that they are in contact with the housing. This allows the lever to be raised or lowered while suppressing deflection of the rotational shaft thereof.

A connector according to the present invention includes: an approximately box-shaped housing having an insertion opening for the insertion of an FPC; forked contact members provided within the housing; and a lever which is provided so as to face the insertion opening of the housing, and which is turnably held by the housing. The forked contact member includes a base held by the housing, an upper arm and a lower arm extending toward the insertion opening from the base, and a forked engaging arm provided so as to extend from the base in the opposite direction of the insertion opening. The lever includes a handle portion, a rotational shaft which is provided to the handle portion and which is held by the housing, and first plate cams which are provided to the rotational shaft, and which are engaged with the engaging arm. With such an arrangement, upon raising the lever through the handle portion, the distance between the tips of the forked engaging arms is increased, thereby increasing the distance between the upper arm and the lower arm of each of the forked contact members. Upon pressing down the lever through the handle portion after the insertion of the FPC, the distance between the tips of the engaging arm of each forked contact member is returned to the initial distance by actions of a corresponding first plate cam. At the same time, the upper arm and the lower arm of each forked contact member are returned to their initial states by the elasticity thereof. In this state, the FPC is held by the elastic force of the forked contact members, thereby maintaining the connection state of the FPC. With such an arrangement, upon raising the handle portion, the distance between the upper arm and the lower arm of each forked contact member is increased to a distance greater than the thickness of the FPC to be inserted into the space between the upper arms and the lower arms of the forked contact members. This enables the user to insert or extract the FPC with a slight application of force. As described above, the connector according to the present invention allows the user to effect a quick connection of an FPC by operating the lever alone.

Furthermore, such a connector allows the user to connect the FPC with the connector with a simple procedure, regardless of the number of the contact terminals.

With such an arrangement, no external stress is applied to each forked contact member during the state in which the FPC is inserted into a space between the arms of the forked contact members and held by the forked contact members. This provides the advantage of preventing deterioration in the durability of the contact members due to creep, for example. That is to say, no external stress is applied to each forked contact member during connection of the FPC to the connector, thereby improving the durability of the contact members thereof.

Furthermore, with such an arrangement, a pair of connection tabs is embedded in both side ends of the housing. Furthermore, the pair of connection tabs holds the rotational shaft through both ends thereof. Such an arrangement allows the user to turn the lever as desired with the rotational shaft as a rotational axis while preventing disengagement of the lever from the housing, thereby improving ease of use.

Furthermore, the second plate cams are formed around the rotational shaft. With such a structure, the second plate cams are provided such that they are in contact with the housing when the lever is in the closed state, thereby stably maintaining the state in which the lever is closed. An arrangement employing such a connector has the advantage of preventing undesirable rising of the lever, thereby maintaining the connection state of the FPC, for example.

Furthermore, the rotational shaft of the lever is formed of rigid metal. This enables the lever to be raised or lowered through the handle portion while suppressing deflection of the rotational shaft.

Furthermore, the first plate cams and the second plate cams are alternately disposed along the rotational shaft of the lever. With such a structure, the second plate cams are provided so as to be in contact with the housing. This enables the lever to be raised or lowered through the handle portion while suppressing deflection of the rotational shaft.

PREFERRED MODE FOR CARRYING OUT THE INVENTION

Description will be made below regarding an embodiment according to the present invention.

Figure 1:
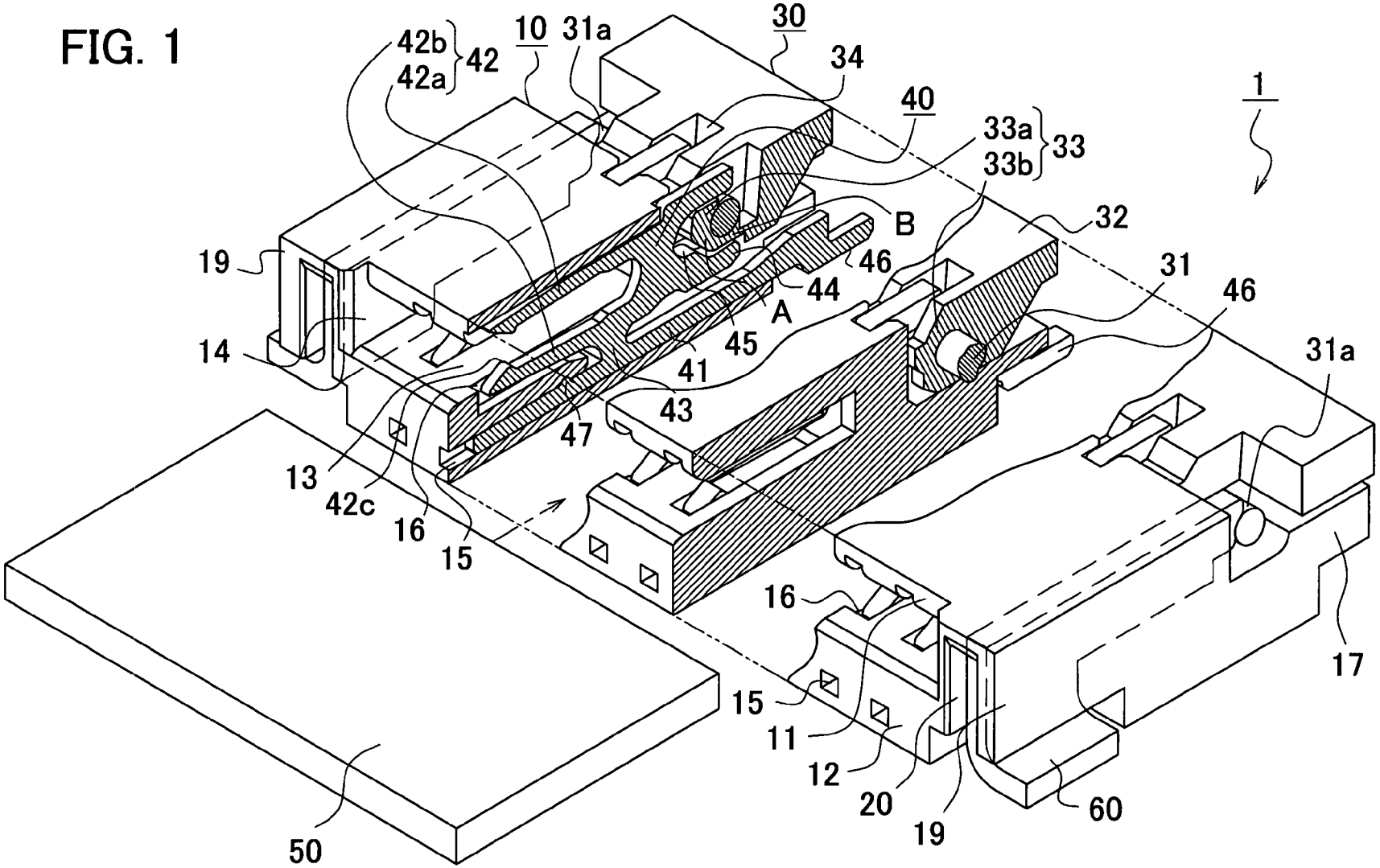
FIG. 1 is a perspective view of a structure of a connector according to an embodiment of the present invention, and shows cross-sections of the principal components.
Figure 2:
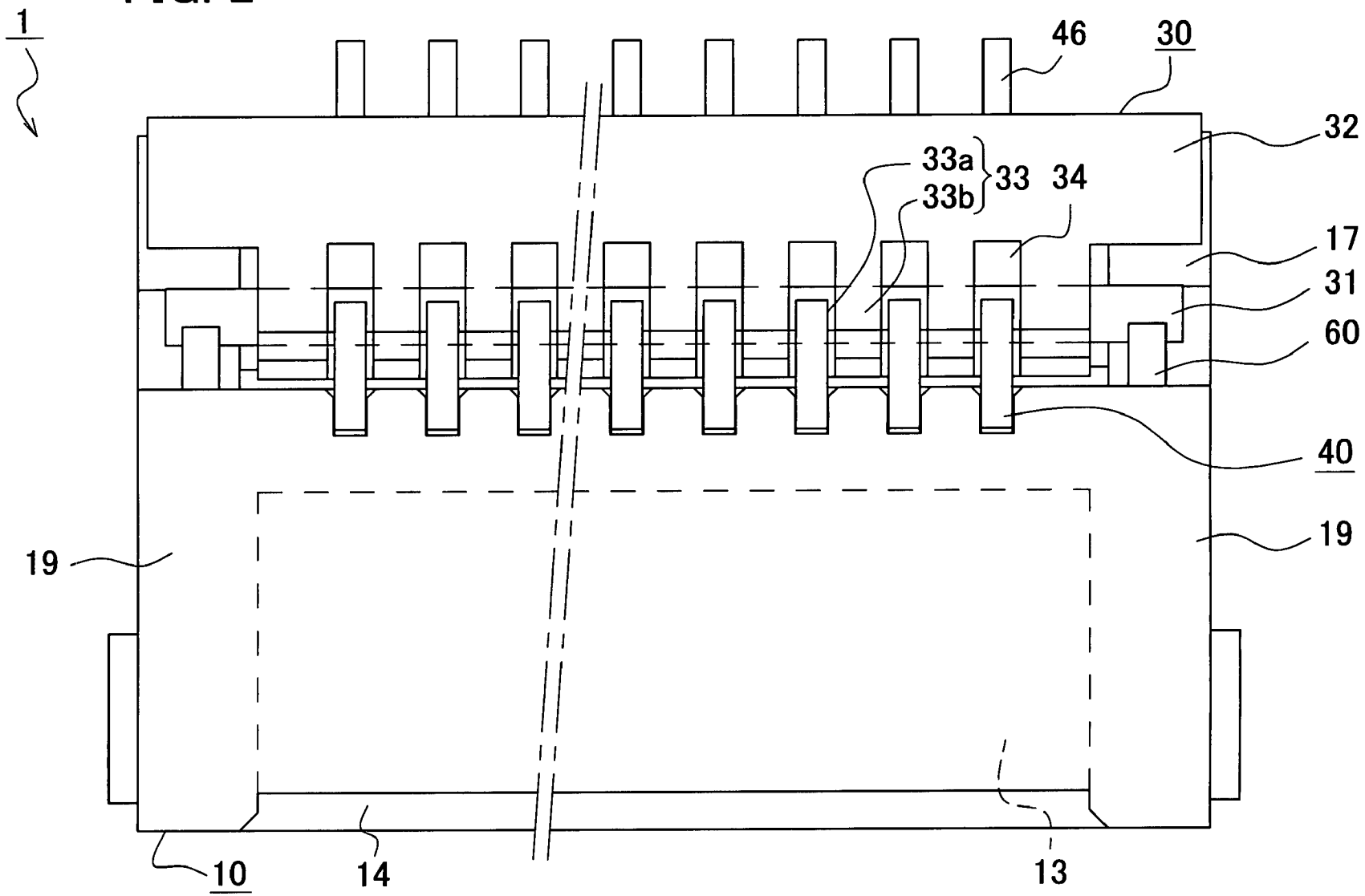
FIG. 2 is a plan view of the connector according to the present invention.
Figure 3:
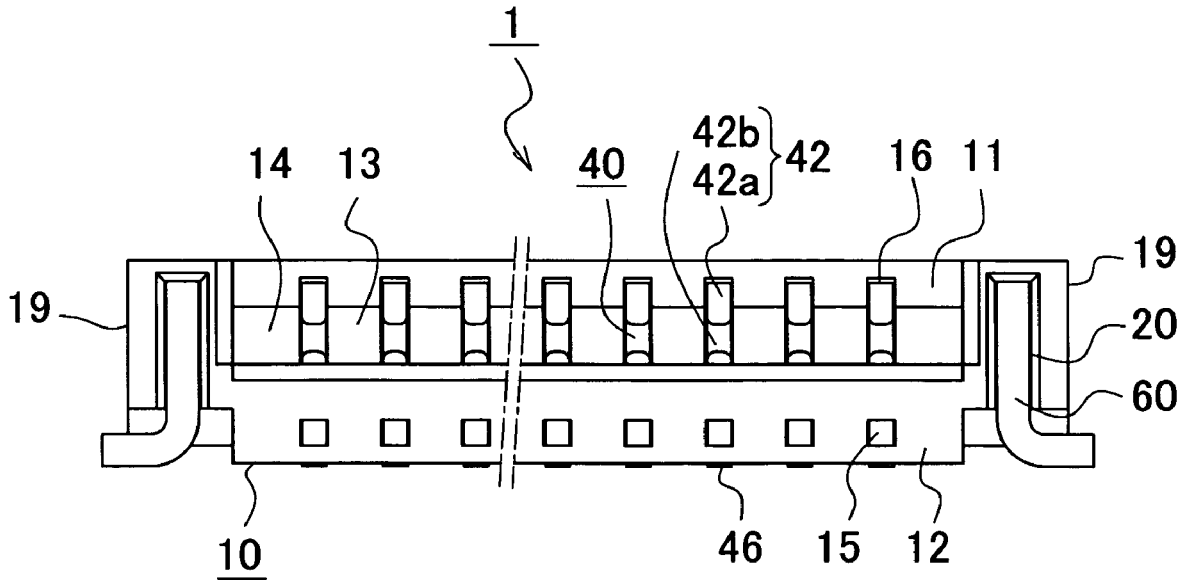
FIG. 3 is a front view of the connector according to the present invention.
Figure 4:
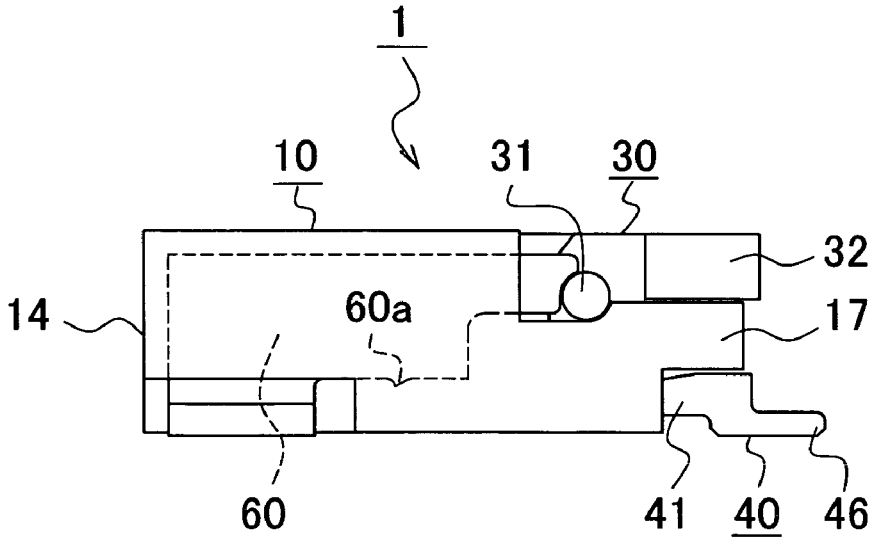
FIG. 4 is a side view of the connector according to the present invention.
Figure 5:
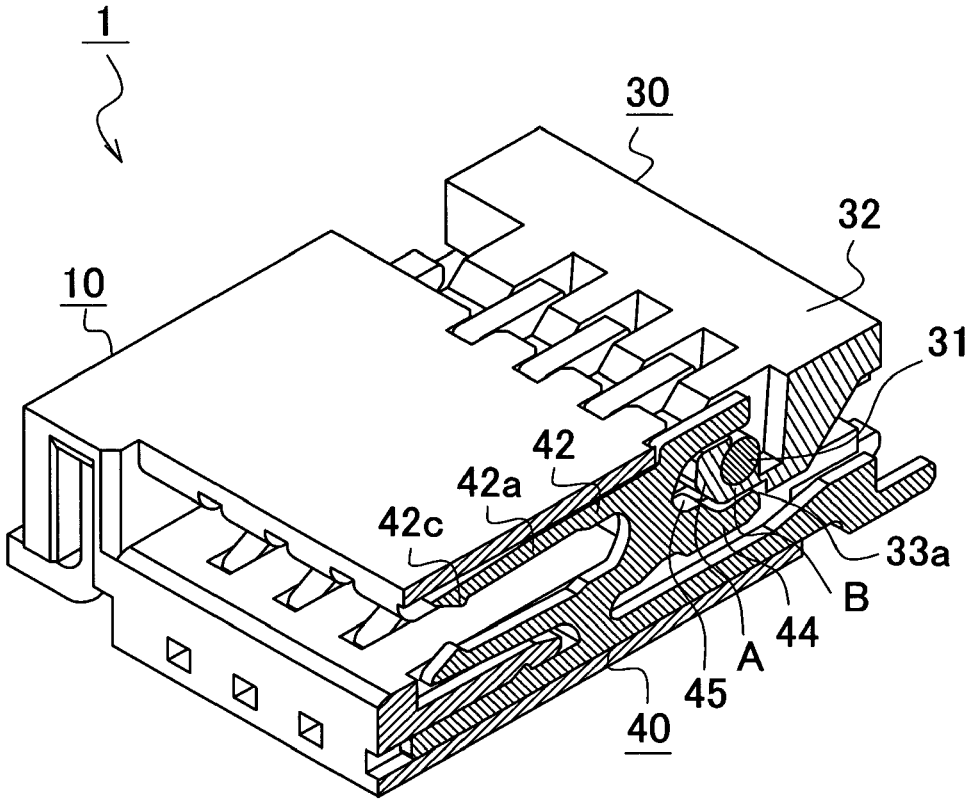
FIG. 5 is a perspective view of the connector according to the present invention, and is a partial cut-away perspective view of the connector before connection of the FPC.
Figure 6:
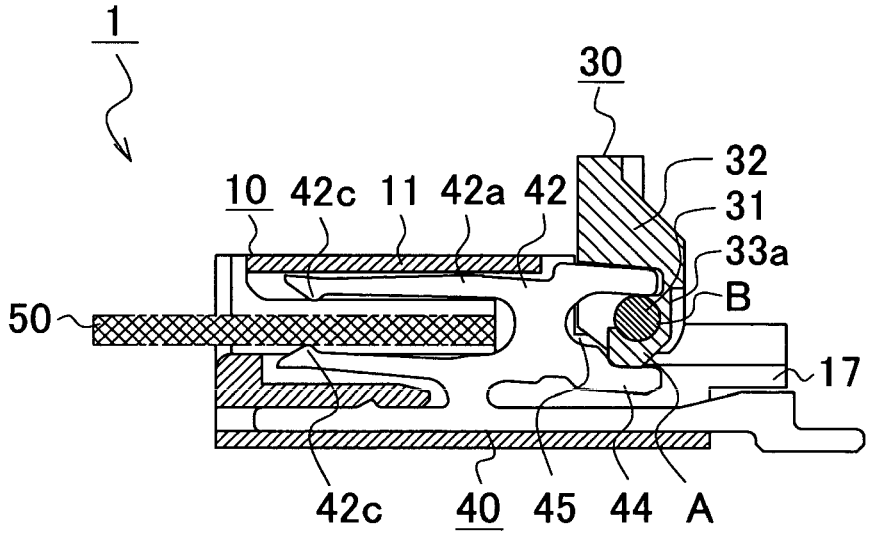
FIG. 6 is a longitudinal cross-sectional view of the connector shown in FIG. 5.
Figure 7:
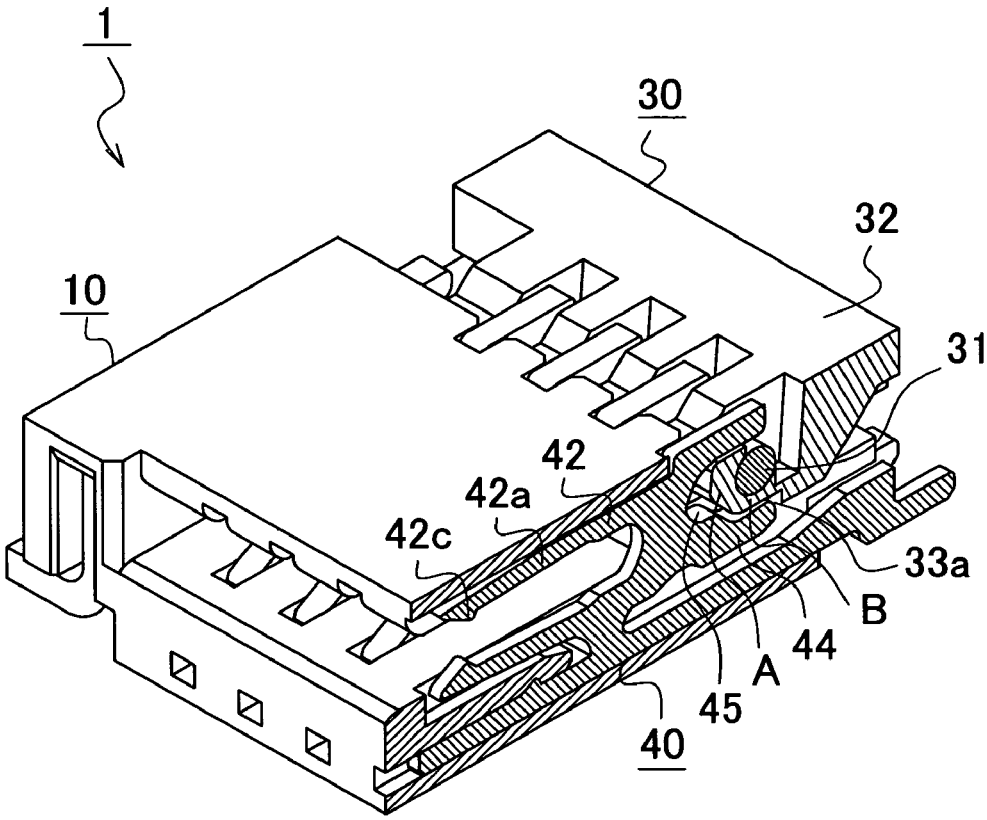
FIG. 7 is a perspective view of the connector according to the present invention, and is a partial cut-away perspective view of the connector in a state in which an FPC is being connected to the connector.
Figure 8:
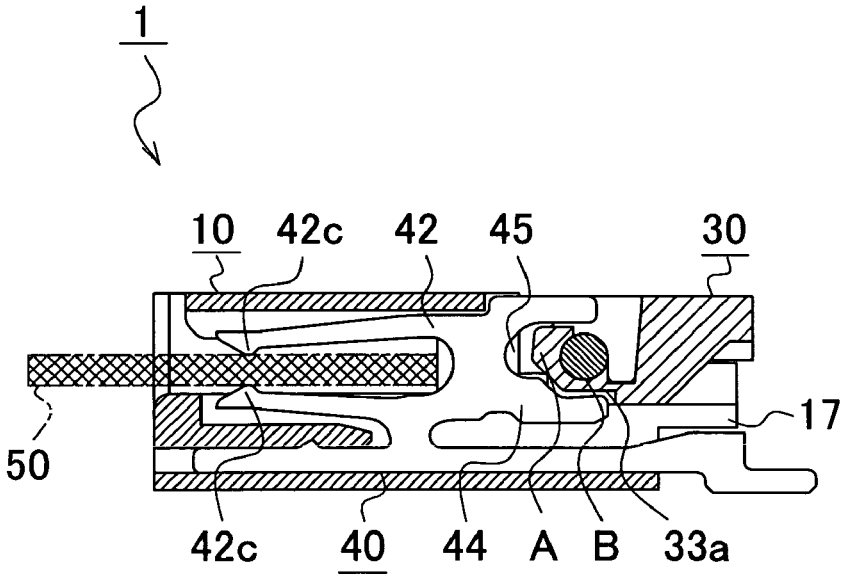
FIG. 8 is a longitudinal cross-sectional view of the connector shown in FIG. 7.

FIG. 1 is a perspective view of a structure of a connector according to an embodiment of the present invention, and shows cross-sections of the principal components. FIG. 2 is a plan view of the connector according to the present invention. FIG. 3 is a front view of the connector according to the present invention. FIG. 4 is a side view of the connector according to the present invention. FIG. 5 is a perspective view of the connector according to the present invention, and is a partial cut-away perspective view of the connector before connection of the FPC. FIG. 6 is a longitudinal cross-sectional view of the connector shown in FIG. 5. FIG. 7 is a perspective view of the connector according to the present invention, and is a partial cut-away perspective view of the connector in a state in which an FPC is being connected to the connector. FIG. 8 is a longitudinal cross-sectional view of the connector shown in FIG. 7. Note that in these drawings, the scale is adjusted as appropriate for convenience of description.

Description will be made regarding a connector according to an embodiment of the present invention with reference to FIGS. 1 through 4.

With regard to the connector shown in FIGS. 1 through 4, a housing 10 is formed of insulating plastic. A connector 1 includes the housing 10 and a lever 30 turnably mounted thereon. Furthermore, multiple forked contact members 40 are disposed on the housing 10 at a predetermined pitch. Each of the forked contact members 40 is formed by fine blanking of a metal film, for example.

The housing 10 includes an upper wall 11 and a lower wall 12 forming an opening 13 for the insertion of an FPC 50. Furthermore, the multiple forked contact members 40 are provided within the opening 13. Multiple grooves 16 are formed in the inner wall of the opening 13 at a predetermined pitch in parallel with the insertion direction for the FPC 50. With such a structure, multiple contact portions 42 are mounted to these grooves 16.

As shown in FIGS. 1 and 4, an insertion opening 14 is formed in front of the opening 13 for the insertion of the FPC 50. The insertion opening 14 allows the insertion of the connection terminal of the FPC 50 to be connected.

The lower wall 12 has fitting openings 15 formed thereon, for fitting bases 41 of the forked contact members 40. Each fitting opening 15 is formed so as to match a corresponding groove 16. Furthermore, each fitting opening communicates with the corresponding groove 16 at an approximately intermediate position. In FIG. 1, the connector has a structure which allows each forked contact member 40 to be mounted from the rear end of the housing 10.

The rear side of the housing 10 (the right side shown in FIGS. 1 and 4) has a structure having no upper wall 11, and will be referred to as "upper open end portion" 17 hereafter. On the other hand, each of both side ends 19 of the housing 10 has an opening 20. Such a structure allows a approximately L-shaped metal connection tab 60 to be inserted into each of the pair of openings 20 from the front side of the housing 10 (from the side of the insertion opening 14) toward the upper open end portion 17, thereby enabling the housing 10 to be fixed to a printed board.

Each connection tab 60 has a base portion which is to be fixed to a printed board (not shown) by soldering. Such a structure allows the housing 10 to be fixed to the printed board. Furthermore, the ends of the connection tabs 60 turnably hold a rotational shaft 31 of the lever 30. Note that each connection tab 60 has a small protrusion 60*a*. Upon pressing the connection tab 60 such that it becomes inserted into the housing 10, the small protrusion 60*a* is fit to the housing 10, thereby fixing the connection tab 60 to the housing 10 (see FIG. 4).

As shown in FIG. 1, the forked contact members 40 are provided such that the bases 41 thereof extend along the lower wall 12 of the housing 10. Note that the forked contact member 40 has a structure in which a U-shaped contact portion 42 formed of an upper arm 42*a* and a lower arm 42*b* is connected to the base 41 through a connection portion 43.

Furthermore, a forked engaging arm 44, having an approximately U-shaped groove 45, is provided to the rear side of the contact portion 42 (on the right side in FIGS. 1 and 4) so as to protrude in the insertion direction. The engaging arm 44 serves as a cantilever with the connection portion 43 as a supporting member. The engaging arm 44 and the upper arm 42*a* are formed as a single unit.

The base 41 is formed in the form of an approximately straight strip. The base 41 has a structure which allows the front end thereof to be fit to the fitting portion 15, thereby enabling the forked contact member 40 to be fixed within the housing 10. Furthermore, contact tabs 46 are formed on the lower side of the rear end of each base 41 so as to protrude toward the outside of the housing 10. Furthermore, a small protrusion 47 is formed on the upper edge of the base 41. Upon applying pressure so as to insert the base 41 into the fitting opening 15, the base 41 is fixed to the fitting opening 15 by the small protrusion 47.

The contact member 42 is formed of the upper arm 42*a* and the lower arm 42*b* such that they extend toward the front side obliquely to one another. With such a structure, the closer to the front side, the narrower the distance between the upper arm 42*a* and the lower arm 42*b*. Furthermore, each arm has a contact point portion 42*c* at the tip thereof, which protrudes toward the inside of the connector so as to face the contact point portion 42*c* of the other arm.

With such a structure in which the upper arm 42*a* and the lower arm 42*b* are formed such that they extend obliquely to one another, there is a space between the tip of the contact portion 42 and each of the upper wall 11 and the lower wall 12 of the housing 10. Such a structure allows the tip portion to be moved in the vertical direction.

A pair of contact point portions 42*c* is formed with a distance therebetween such that upon applying pressure to the FPC 50 so as to insert it into the connector, the connector holds the FPC 50 through the contact point portions 42*c*. That is to say, a pair of contact point portions 42*c* is formed with a somewhat smaller distance therebetween than the thickness of the connection terminal of the FPC 50.

Note that the thickness of the connection terminal of the FPC 50 is not restricted in particular. Instead, FPCs of connection terminals with various thicknesses are employed, depending upon the usage of the connector 1 according to the present invention. For example, FPCs of connection terminals with thicknesses of 0.3 mm, 0.2 mm, and 0.12 mm are employed for digital cameras (DSC, DVC), cellular phones, and so forth.

Each forked contact member 40 is inserted toward the insertion opening 14 from the rear side of the housing 10, whereby each forked contact member 40 is mounted to the corresponding groove 16. At this time, the front end of the base 41 of each forked contact member 40 is fit to the corresponding fitting opening 15. Furthermore, the forked contact member 40 is fixed to the fitting opening 15 with the small protrusion 47 formed on the upper edge of the base 41 fit to a partition 18 of the housing 10. This ensures insertion of the forked contact member 40 into the housing 10 to a predetermined insertion depth. Furthermore, such a structure prevents undesirable disengagement of the forked contact member 40 from the housing 10.

With such a structure in which these forked contact members 40 are disposed, the contact portions 42 are disposed within the opening 13 of the housing 10 so as to face the insertion opening 14.

On the other hand, each contact tab 46 is disposed such that the bottom thereof is approximately level with the bottom face of the lower wall 12 of the housing 10. Furthermore, each contact tab 46 is disposed so as to protrude toward the outside of the housing 10. The contact tabs 46 are connected to a printed board (not shown) by soldering, thereby connecting the forked contact members 40 with the printed board.

Note that the multiple contact members 42 do not need to be formed with the same length. For example, an arrangement may be made in which two types of contact members 42 are provided with the length of one being greater than the length of the other. Furthermore, an arrangement may be made in which these two types of contact members 42 are alternately provided, thereby forming a staggered array of contact points for the inserted FPC 50. With such a structure, the FPC 50 does not receive the contact stress along a single line (linear stress), thus presenting the advantage of enabling the FPC 50 to be inserted while preventing the buckling or folding thereof.

The lever 30 includes a rotational shaft 31 of a metal cylinder and a handle portion 32 of an insulating plastic in the shape of an approximately rectangular plate, forming a single unit. The lever 30 is mounted on the upper face of the upper open end portion 17 on the rear side of the housing 10. Note that the rotational shaft 31 may be formed of a metal rod coated with an insulating film such as enamel or the like. This improves the insulation performance of the connector.

The handle portion 32 has the same number of opening grooves 34 as there are grooves 16 formed in the housing 10. With such a structure, each opening groove 34 is formed so as to match the corresponding groove 16, which enables the forked contact member 40 to be mounted while preventing the engaging arm 44 thereof from coming in contact with the handle portion 32.

Furthermore, two types of plate cams, i.e., a first plate cam 33*a* and a second plate cam 33*b* are alternately disposed along the rotational shaft 31, serving as a compound plate cam 33. The first plate cam 33*a* is engaged with the forked engaging arm 44, thereby forming a cam arrangement. Note that the first plate cam 33*a* is formed in a shape having a thicker portion A serving as a cam follower for increasing the amount of lift and a thinner portion B serving as a cam follower for reducing the amount of lift.

As shown in FIG. 1, each first plate cam 33*a* is provided so as to be introduced into a notch 45 of the forked portion of the forked engaging arm 44. As shown in FIGS. 1 and 4, the lever 30 is turnably held with both ends of the rotational shaft 31 being held by the ends of the contact tabs 60 and the upper open end portion 17.

Furthermore, a second plate cam 33*b* is provided between the adjacent forked contact members 40. With such a structure, upon pressing down the lever 30 such that it closes over the upper open end portion 17 formed on the rear side of the housing 10, each second plate cam 33*b* comes in contact with the upper face of the upper open end portion 17, as shown in FIG. 1

With such a structure in which the lever 30 is mounted to the housing 10, the first plate cam 33*a* is engaged with each engaging arm 44, thereby forming a cam arrangement which engages each first plate cam 33*a* with a corresponding engaging arm 44 (see FIG. 1). Such a structure allows the user to change the position of the engaging arms 44 by turning the lever 30 through the first plate cams 33*a*.

Upon closing the lever 30, the lever 30 is stored on the upper open end portion 17 of the housing 10 as shown in FIG. 1. In this state, the lever is stored so as to cover the rear side of the housing 10, thus serving as a cover. Furthermore, in this state, each second plate cam 33*b* is in contact with the upper face of the upper open end portion 17. This enables the lever 30 to be stably held on the upper open end portion 17.

Next, description will be made regarding connection of the FPC 50 to the connector 1 according to the present invention with reference to FIGS. 5 through 8.

FIGS. 5 and 6 show the connector 1 without the FPC 50 being connected thereto. As shown in FIGS. 5 and 6, upon turning the lever 30 such that it is raised to an approximately perpendicular position, i.e., the open position, the first plate cam 33*a* engaging with the notch 45 is turned, thereby moving downwards the thicker portion A. This movement of the thicker portion A presses down the engaging arm 44 of the forked contact member 40.

Upon pressing down the engaging arm 44, the tip of the upper arm 42*a* of the forked contact portion 42 moved toward the upper wall 11 of the housing 10, and the lower arm 42*b* of the forked contact portion 42, which is directly connected to the base, does not move. This increases the distance between the contact point portions 42*c* formed at the tips of each forked contact portion 42. With the present embodiment, the forked contact portion 42 is designed such that the distance between the contact point portions 42*c* is greater than the connection portion of the FPC 50 when the engaging arm 44 of the forked contact member 40 is pressed down. Such a structure allows the user to insert the FPC 50 into the connector 1 without any stress.

Next, upon turning the lever 30 to an approximately horizontal position, i.e., the closed position, after the insertion of the FPC 50, as shown in FIGS. 7 and 8, each first plate cam 33*a* engaging with the notch 45 of the engaging arm 44 is turned, thereby turning the thicker portion A so as to face the insertion opening 14 (the left side in FIG. 8). After this action, the first plate cam 33*a* is situated such that the thinner portion B faces the engaging arm 44. This releases the force which has been applied to the engaging arm 44 so as to press down upon it.

This releases the force which has been applied to the upper arm 42*a* of each forked contact portion 42, and which elastically bends the tip thereof. This returns each upper arm 42*a* to an initial position, thereby returning the distance between each pair of contact point portions 42*c* to an initial distance.

With the present embodiment, the initial distance between each pair of contact point portions 42*c* is set to a smaller distance beforehand than the thickness of the connection terminal of the FPC 50 to be inserted. This enables the FPC 50 thus inserted, to be held by the contact point portions 42*c* while maintaining a connection therebetween. In this state, each contact portion 42 is returned to the state in which the contact portion 42 is not elastically bent. That is to say, external stress is not applied to any contact portion 42. This improves the durability of the connector.

With such a structure, in the state in which each first plate cam 33*a* is situated such that the thinner portion B thereof faces the corresponding engaging arm 44, there is a space therebetween without connection. This prevents a short circuit while maintaining connection between the FPC 50 and each forked contact member 40.

Specific description has been made regarding the connector according to the present invention with reference to the drawings which show examples thereof. The present invention is not restricted to the examples shown in the drawings. Rather, it is to be understood that changes and modifications may be made as appropriate without departing from the technical scope of the present invention.

The invention claimed is:

1. A connector comprising:

an approximately box-shaped housing having an insertion opening for insertion of a flat flexible cable;

a forked contact member provided within said housing; and a lever which is disposed on a side opposite to the insertion opening and turnably supported by said housing, wherein said forked contact member includes a base held by said housing, an upper arm and a lower arm extending toward said insertion opening from said base, and a forked engaging arm extending from said base in the opposite direction of said insertion opening, said lever includes a handle portion, a rotational shaft supported by said housing to provide a rotational axis to said handle portion, and a first plate cam provided to said rotational shaft to engage with said engaging arm, and said lever raised by rotating said handle portion causes a thicker portion of the first plate cam to depress the engaging arm so as to move the upper arm upward, thereby increasing a distance between the upper arm and the lower arm.

2. A connector according to claim 1, wherein said housing includes a pair of connection tabs for connection to a printed board, embedded in both side ends thereof with said insertion opening introduced therebetween, and the connection tabs support both side ends of rotational shaft of said lever rotatably.

3. A connector according to claim 1, wherein said rotational shaft is formed of rigid metal, and said handle portion is formed of an insulating material and, said rotational shaft and said handle shaft form a single unit.

4. A connector according to any one of claims 1 through 3, wherein said lever includes second plate cam which is provided to said rotational shaft, and which is engaged with said housing.

5. A connector according to claim 4, wherein said first plate cams and said second plate cams are alternately disposed along the axial direction of said rotational shaft.

6. A connector comprising:

an insulating housing having an insertion opening for insertion of a flat flexible cable and an upper open end portion;

a lever opening and closing the upper open end portion; and a plurality of forked contact members provided within the housing, the plurality of forked contact members connecting the flat flexible cable;

wherein each forked contact member includes a base held by the housing and having a connection portion, a contact portion arranged within the insertion opening, and having an upper arm and a lower arm, the lower arm being connected to the base through the connection portion, and a forked engaging arm protruding in a direction opposite to the contact portion and having an upper engaging arm and a lower engaging arm;

wherein the lever includes a rotational shaft supported by the housing, a handle portion, and a first plate cam disposed around the rotational shaft, engaged with the forked engaging arm, and having a thicker portion and a thinner portion; and wherein upon turning the lever to the open position, the thicker portion depresses the lower engaging arm so as to move the upper arm upward, thereby increasing a distance between the upper arm and the lower arm.

7. A connector according to claim 6, wherein upon turning the lever to the closed position, the thinner portion faces the lower engaging arm so as to move the upper arm downward, thereby decreasing a distance between the upper arm and the lower arm.

8. A connector according to claim 6, further comprising a pair of connection tabs on both side ends of the housing wherein the pair of connection tabs includes a base portion fixed to a printed board by soldering, and an end portion turnably support the both ends of the rotational shaft.

9. A connector according to claim 6, wherein the rotational shaft is formed of rigid metal and the handle portion is formed of an insulating material, and the rotational shaft and the handle portion form a single unit.

10. A connector according to any one of claims 6 through 9, wherein the lever includes a second plate cam which is in contact with the upper face of the upper open end portion, thereby stably maintaining the state in which the lever is closed.

11. A connector according to claim 10, wherein the first plate cams and the second plate cams are alternately disposed along the axial direction of the rotational shaft.

* * * * *